US007096807B1

(12) United States Patent
Chang

(10) Patent No.: US 7,096,807 B1
(45) Date of Patent: Aug. 29, 2006

(54) NEEDLE ASSEMBLY FOR EMBROIDERY MACHINE

(76) Inventor: Tseng Hsien Chang, 9F., No. 270, Gaogong Rd., South District, Taichung City 402 (TW)

( * ) Notice: Subject to any disclaimer, the term of this patent is extended or adjusted under 35 U.S.C. 154(b) by 0 days.

(21) Appl. No.: 11/219,601

(22) Filed: Sep. 1, 2005

(51) Int. Cl.
*D05B 73/04* (2006.01)
*D05B 55/00* (2006.01)

(52) U.S. Cl. ..... 112/258; 112/226

(58) Field of Classification Search ..... 112/258, 112/225, 226, 227, 260, 261, 163; 312/208.05, 312/330.01; D06/510
See application file for complete search history.

(56) References Cited

U.S. PATENT DOCUMENTS 418,049 A * 12/1889 Muther ..... 112/226
423,113 A * 3/1890 Baker ..... 112/226
1,272,910 A * 7/1918 Brown ..... 112/45
2,036,959 A * 4/1936 Rubel ..... 112/226
4,150,633 A * 4/1979 Adams ..... 112/260
4,220,103 A * 9/1980 Kasahara et al. ..... 112/260
5,154,590 A * 10/1992 Klein ..... 112/260
5,343,821 A * 9/1994 Tseng ..... 112/258

* cited by examiner

*Primary Examiner*—Ismael Izaguirre
(74) *Attorney, Agent, or Firm*—Charles E. Baxley

(57) ABSTRACT

An embroidery machine includes a base and an arm connected to an upright column post on the base. A needle bar is movably connected to the arm and a needle frame is connected to a distal end of the needle bar. A needle unit is connected to the needle frame and removably extends through the holes in a needle plate on a top of the base. An alignment device is connected between the needle bar and the needle frame so that the needle frame can be connected to the needle bar by a guidance of the alignment device.

18 Claims, 8 Drawing Sheets

NEEDLE ASSEMBLY FOR EMBROIDERY MACHINE

FIELD OF THE INVENTION

The present invention relates to a needle assembly which includes an alignment device for quickly installing needle unit to the needle bar.

BACKGROUND OF THE INVENTION

A conventional way to make an embroidery badge employs a sewing machine to embroider a pattern on a base fabric and this is a time consuming task. Some manufacturers develop another convenient way to attach small pieces of fabrics with different colors on the base fabric. However, it needs chemical adherents to glue the small pieces of fabrics to the base fabric and takes time to dry the adherents. The small pieces of fabrics could be peeled off from the base fabric after a period of time.

The present invention intends to provide a needle assembly for an embroidery machine wherein the needle unit can be quickly and easily installed to the needle bar. A protection device is located beneath the needle plate to prevent users' fingers from entering the space beneath the needle plate.

SUMMARY OF THE INVENTION

The present invention relates to an embroidery machine that comprises a base having an upright column and an arm has an end connected to the upright column. A needle bar is movably connected to the arm and a needle frame is connected to a distal end of the needle bar and a needle unit is connected to the needle frame. The needle plate is located beneath the needle unit which removably extends through holes in a needle plate connected to a top of the base. An alignment device is connected between the needle bar and the needle frame so that the needle frame is connected to the needle bar by a guidance of the alignment device.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
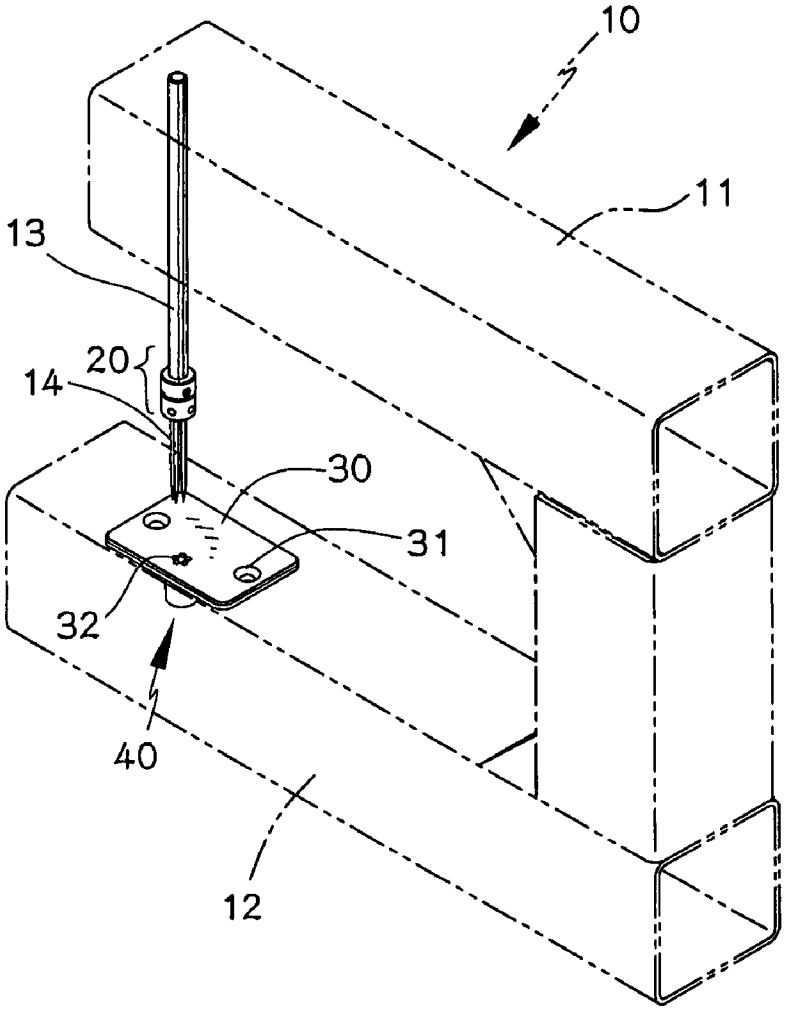
FIG. 1 shows an embroidery machine with the needle assembly of the present invention.
Figure 2:
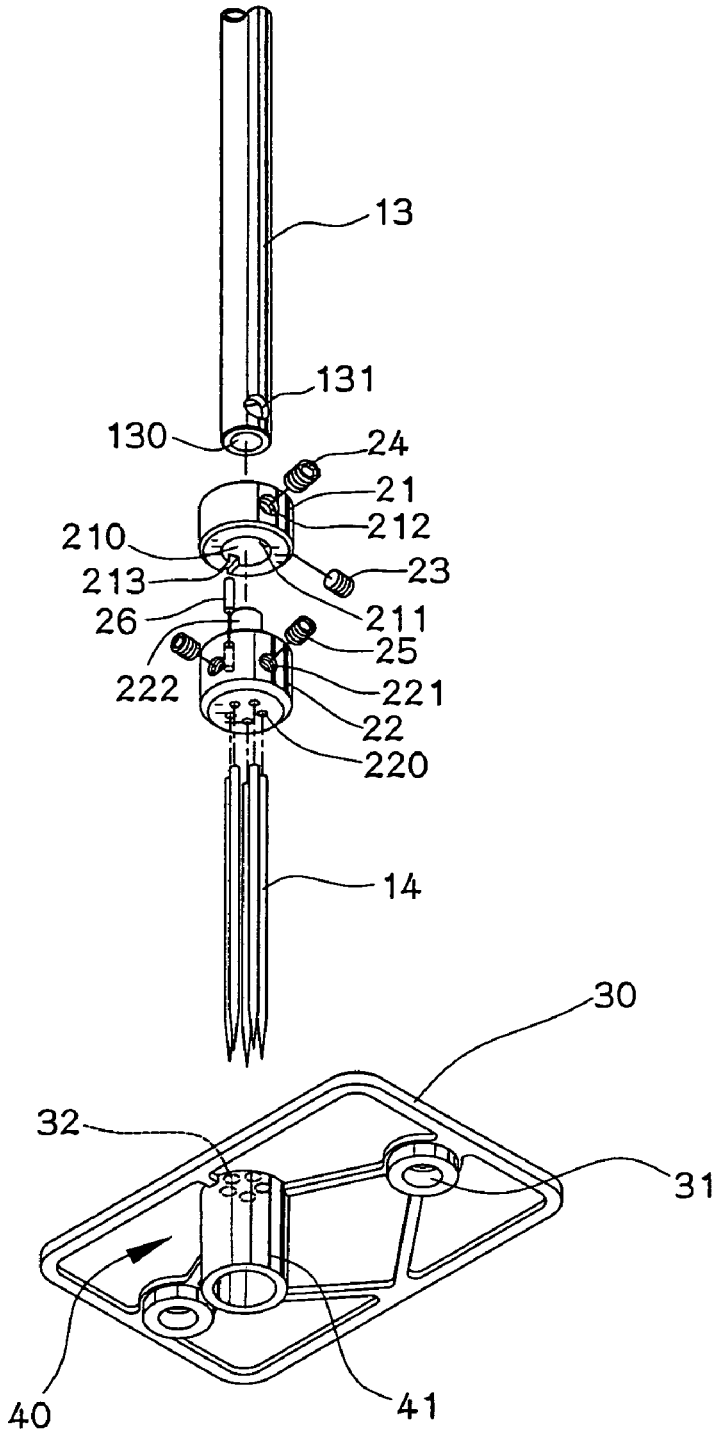
FIG. 2 is an exploded view to show the needle assembly of the present invention.
Figure 3:
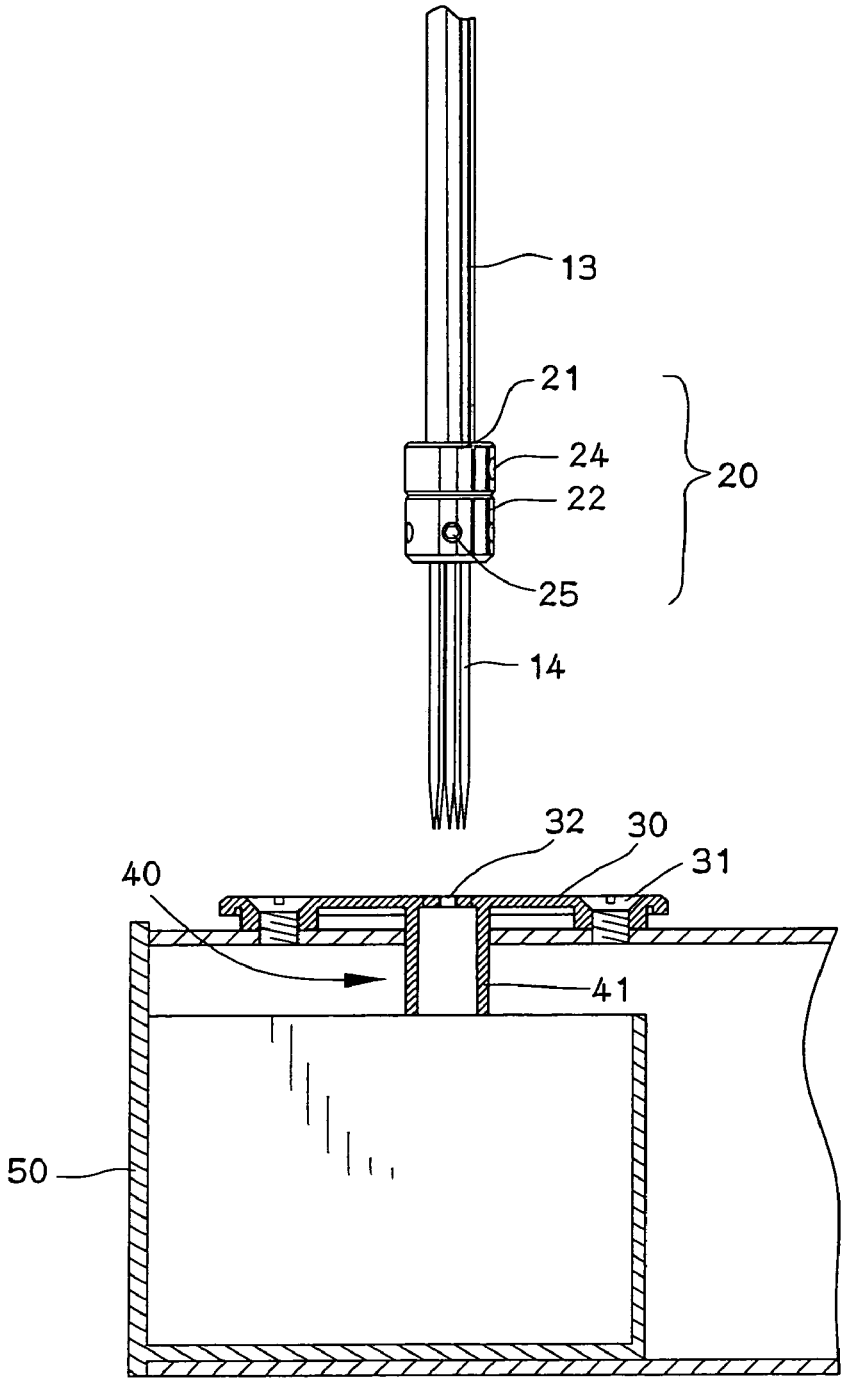
FIG. 3 is a cross sectional view to show the needle assembly of the present invention.

Referring to FIGS. 1 to 3, an embroidery machine 10 includes a base 12 having an upright column and an arm 11 has an end connected to the upright column. A needle bar 13 is movably connected to the arm 11 and driven by a power system (not shown) in the arm 11. A needle plate 30 is connected to a top of the base 12 by screws extending through holes 31 in the needle plate 30 and connected to the base 12. The needle plate 30 has needle holes 32 defined therethrough.

A quick connection device 20 is used to quickly install the needle unit 14 to the needle bar 13 and includes a positioning member 21 and a needle frame 22. The positioning member 21 is fixedly mounted to the needle bar 13 and has a central hole 210 which communicates with a bottom hole 130 defined in a distal end of the needle bar 13. The needle bar 13 further has a radial hole 131 which communicates with the bottom hole 130. The positioning member 21 includes a first positioning hole 211 and a second positioning hole 212 defined radially therethrough which communicate with the central hole 210. A positioning bolt 23 threadedly extends through the first positioning hole 211 and contacts an outside of the needle bar 13 to position the positioning member 21 onto the needle bar 13.

The needle frame 22 has an insertion 222 extending from a top thereof and the insertion 222 extends through the central hole 210 and is inserted into the bottom hole 130. Another positioning bolt 24 threadedly extends through the second positioning hole 212 and the radial hole 131 and contacts an outside of the insertion 222 to connect the needle frame 22 to the needle bar 13. The needle unit 14 includes a plurality of needles which are inserted into receiving holes 220 defined in an underside of the needle frame 22 and a plurality of contact bolts 25 threadedly extend through radial holes 221 defined in the needle frame 22 and contact the needles.

An alignment device includes a notch 213 defined in an underside of the positioning member 21 and a positioning piece 26 is axially connected to the needle frame 22. When installing the needle assembly, the positioning piece 26 is engaged with the notch 213 so that the assemblers can easily and conveniently assemble the needle assembly.

A protection device 40 is a tubular member 41 which has one end fixed to an underside of the needle plate 30 and has a longitudinal passage which is located corresponding to the needle holes 32. Therefore, the protection device 40 prevents user's fingers from entering the area that the needles of the needle unit 14 extend through the needle holes 32. A collection drawer 50 is removably connected to the base 12 and has an open top which faces the needle holes 32 of the needle plate 30 so as to collect the shredded fabrics.

Figure 4:
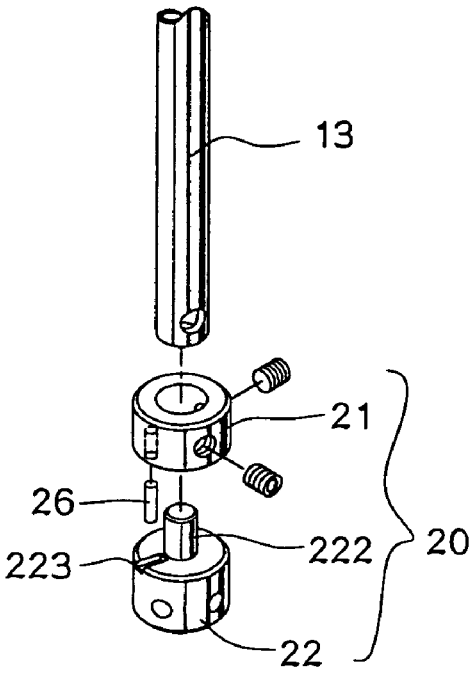
FIG. 4 is an exploded view to show a second embodiment of the needle assembly of the present invention.

FIG. 4 shows a second embodiment of the needle assembly of the present invention, wherein the alignment device includes a notch 223 defined in a top of the needle frame 22 and a positioning piece 26 is axially connected to an underside of the positioning member 21 so as to be engaged with the notch 223.

Figure 5:
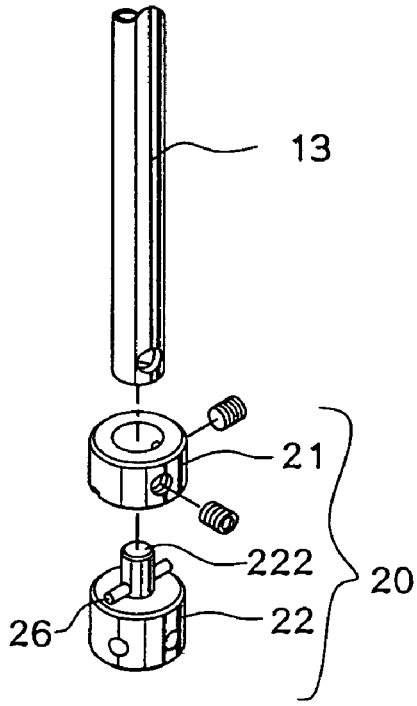
FIG. 5 is an exploded view to show a third embodiment of the needle assembly of the present invention.

FIG. 5 shows a third embodiment of the needle assembly of the present invention, wherein the alignment device includes two notches 213 are defined in an underside of the positioning member 21 and two positioning pieces 26 extend radially from the insertion 222 of the needle frame 22 so as to be engaged with the notches 213.

Figure 6:
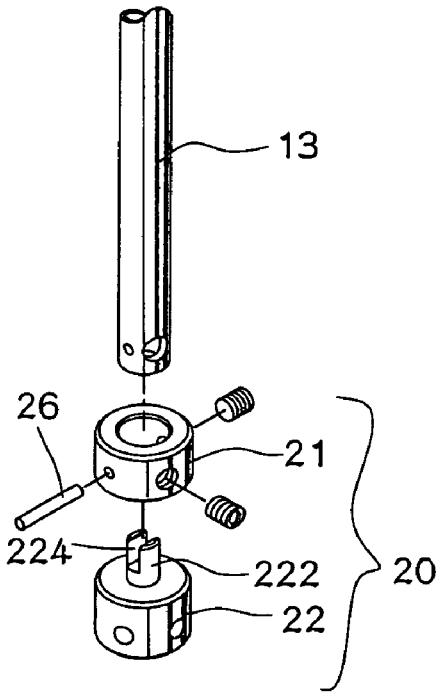
FIG. 6 is an exploded view to show a fourth embodiment of the needle assembly of the present invention.

FIG. 6 shows a fourth embodiment of the needle assembly of the present invention, wherein the alignment device includes a positioning piece 26 extends radialy through the positioning member 21 and the insertion 222 of the needle frame 22 has a groove 224 defined in a top thereof, the positioning piece 26 is engaged with the groove 224.

Figure 7:
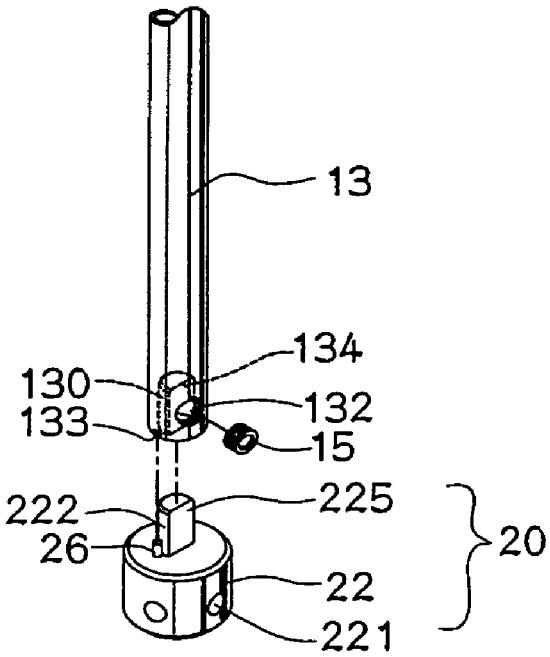
FIG. 7 is an exploded view to show a fifth embodiment of the needle assembly of the present invention.

FIG. 7 is an exploded view to show a fifth embodiment of the needle assembly of the present invention, wherein the quick connection device includes only the needle frame 22, wherein the bottom hole 130 includes a first flat surface 134 defined in an inside thereof and the insertion 222 includes a second flat surface 225 which is matched with the first flat surface 134. A side hole 132 is defined radially in the needle bar 13 and communicates with the bottom hole 130 and a bolt 15 threadedly extends through the side hole 132 and contacts the second flat surface 225 of the insertion 222. The alignment device includes a notch 133 defined in the distal end of the needle bar 13 and a positioning piece 26 extends from the needle frame 22 so as to be engaged with the notch. 133.

Figure 8:
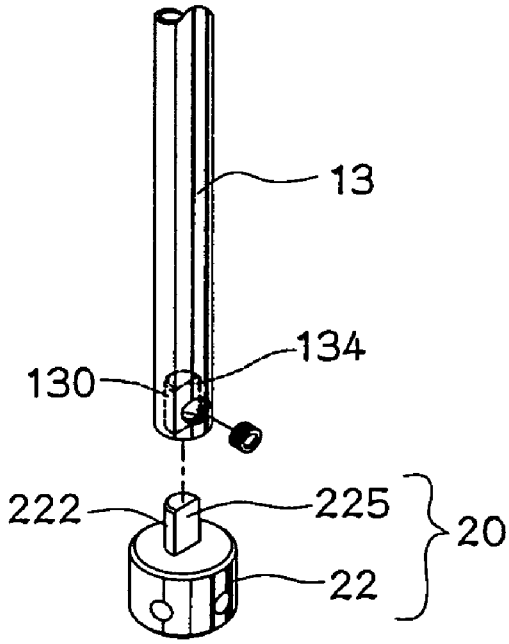
FIG. 8 is an exploded view to show a sixth embodiment of the needle assembly of the present invention.

FIG. 8 shows a sixth embodiment of the needle assembly of the present invention, wherein the alignment device is the first and second flat surfaces 134, 225 so that the needle frame 22 can be easily connected to the needle bar 13 by matching the first and second flat surfaces 134, 225.

Figure 9:
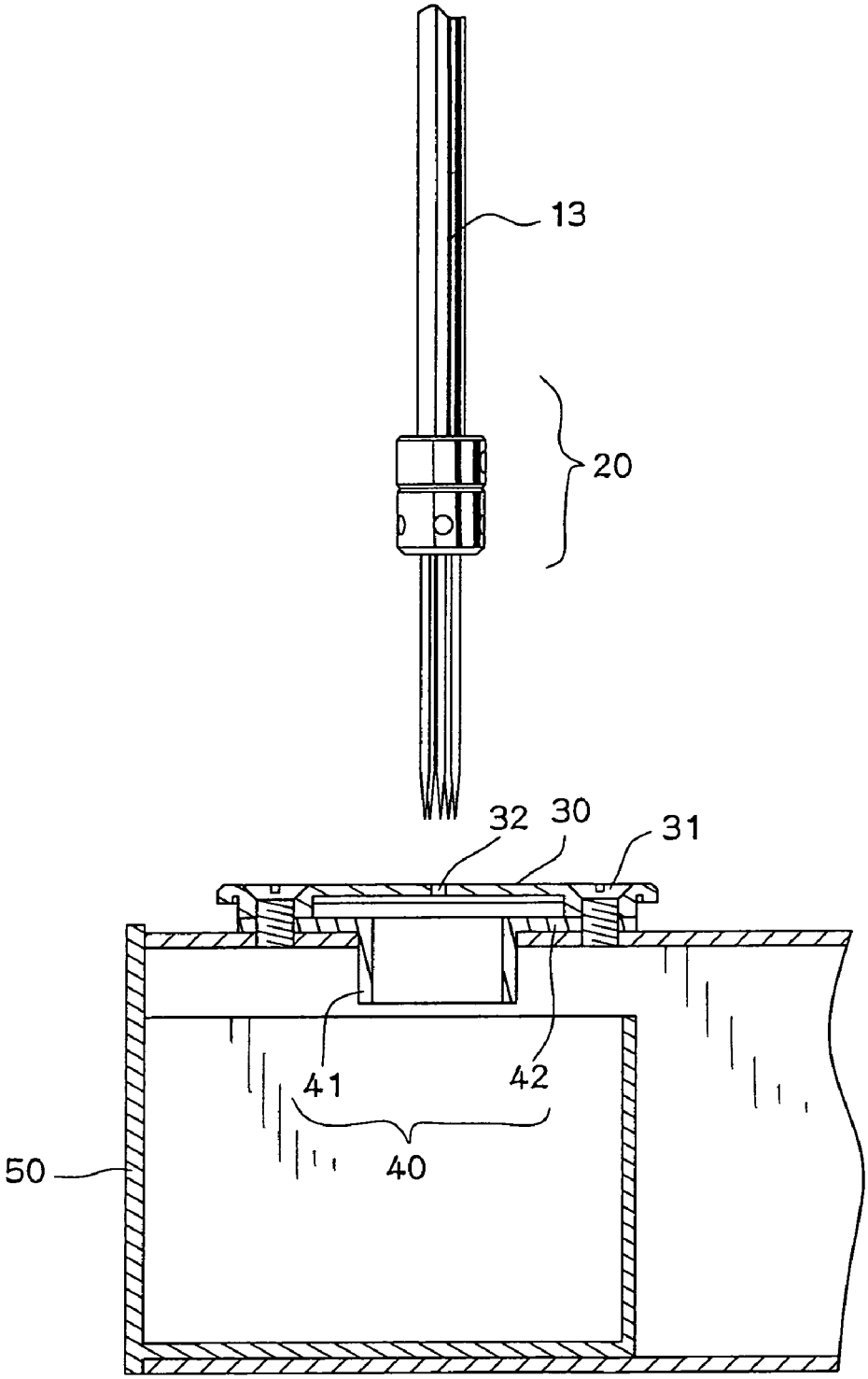
FIG. 9 shows a second embodiment of the protection device.

FIG. 9 shows that the protection device 40 includes a board 42 and the tubular member 41 which extends from the board 42 and the passage of the tubular member 41 opens through the board 42. The board 42 is fixed to the base 12 together with the needle plate 30 by screws.

Figure 10:
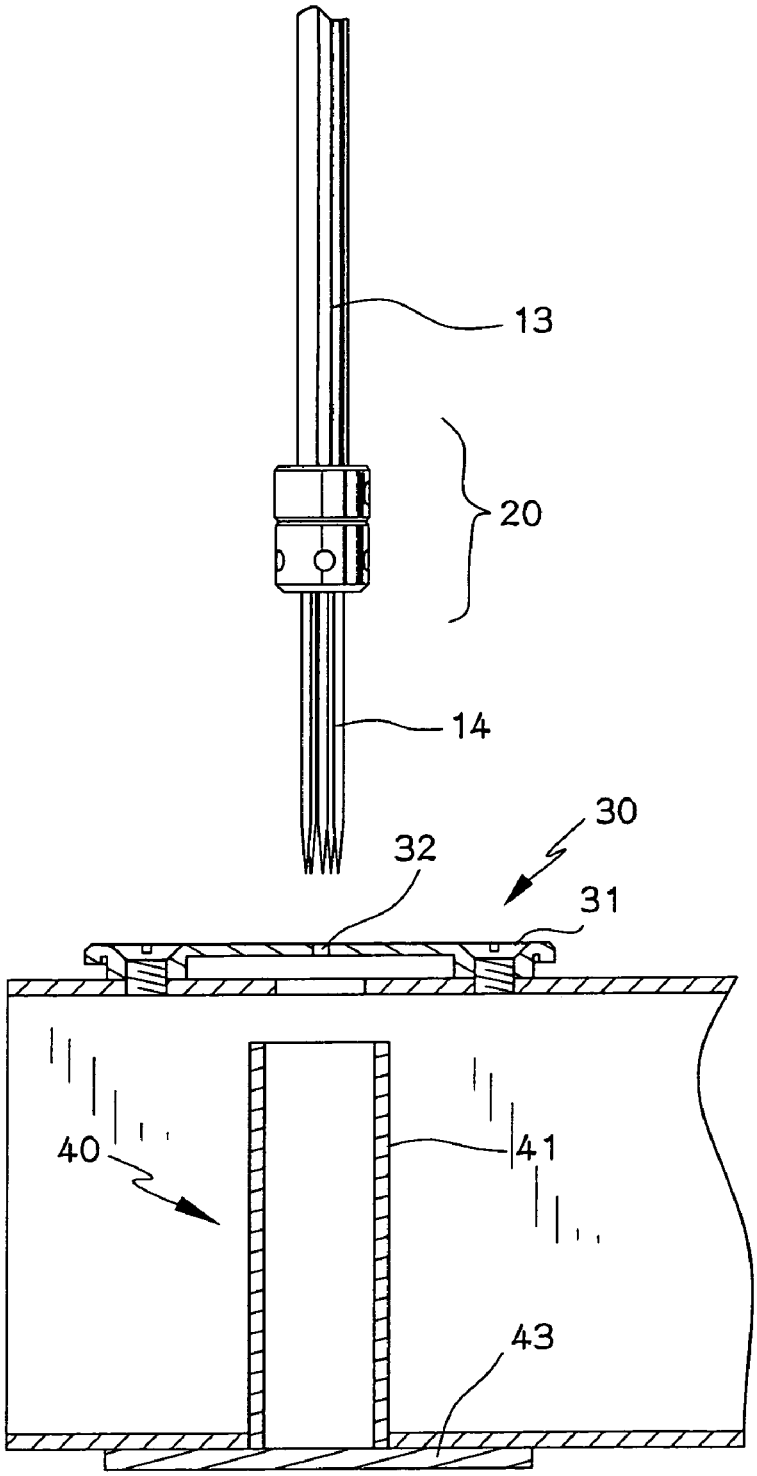
FIG. 10 shows a third embodiment of the protection device.

FIG. 10 shows a second embodiment of the protection device 40 wherein the tubular member 41 extends from a board 43 which is fixed to an underside of the base 12 and the tubular member extends toward the needle holes 32 of the needles plate 30.

Figure 11:
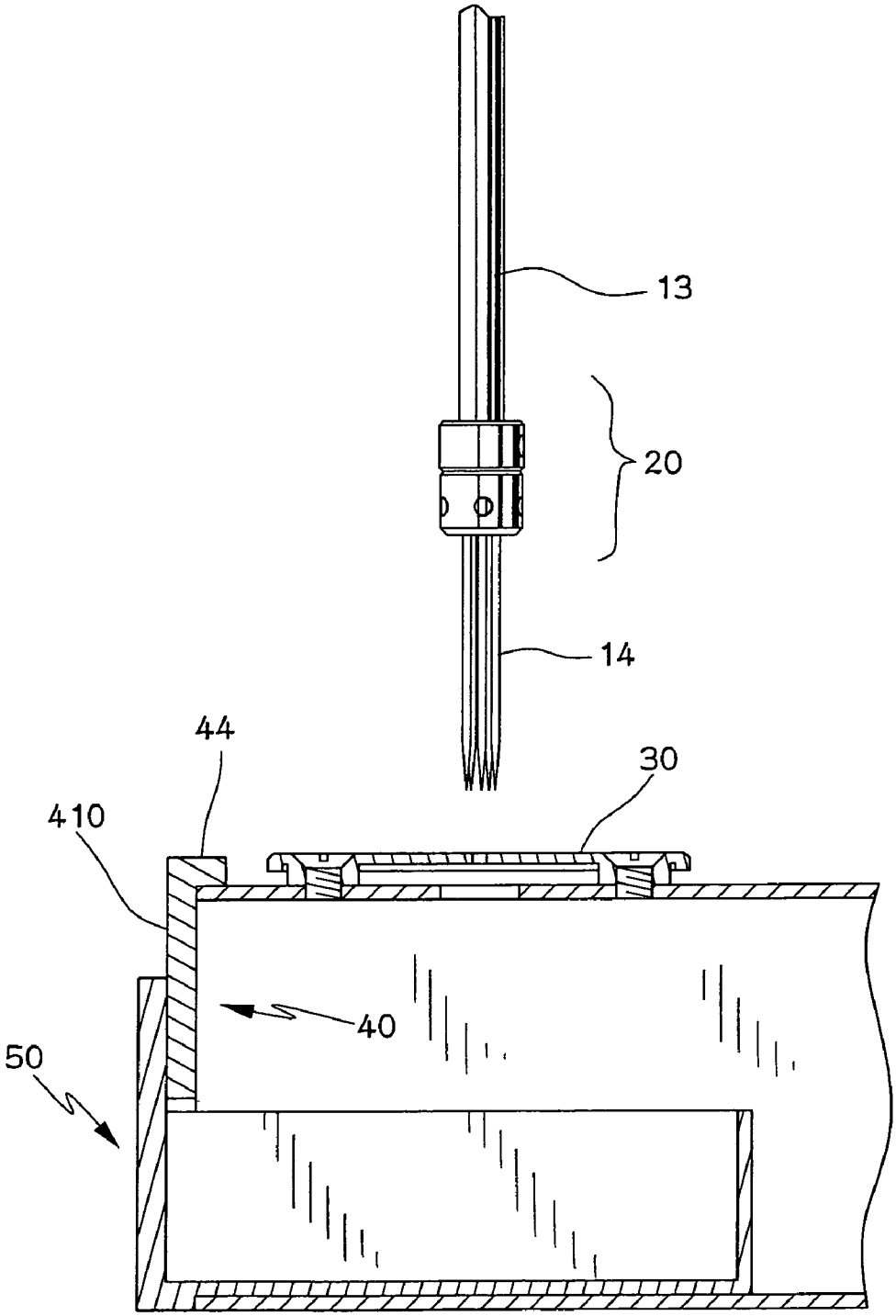
FIG. 11 shows a fourth embodiment of the protection device.

FIG. 11 shows a third embodiment of the protection device 40 which is a board 410 fixed to a distal end of the base 12 and has a top flange 44 overlapped on the top surface of the bas 12. The collection drawer 50 is removably inserted beneath a lower end of the board 410.

While we have shown and described the embodiment in accordance with the present invention, it should be clear to those skilled in the art that further embodiments may be made without departing from the scope of the present invention.

What is claimed is:

1. An embroidery machine comprising:

a base having an upright column and an arm having an end connected to the upright column, a needle bar movably connected to the arm, a needle plate connected to a top of the base, the needle plate having needle holes defined therethrough;

a needle frame connected to a distal end of the needle bar and a needle unit connected to the needle frame, the needle plate located beneath the needle unit which removably extend through the holes in the needle plate;

an alignment device connected between the needle bar and the needle frame so that the needle frame is connected to the needle bar by a guidance of the alignment device, and a collection drawer removably connected to the base and having an open top which faces the needle holes of the needle plate.

2. The embroidery machine as claimed in claim 1, wherein a bottom hole is defined in a distal end of the needle bar and the needle frame has an insertion which is securely inserted into the bottom hole.

3. The embroidery machine as claimed in claim 2, wherein the bottom hole includes a first flat surface defined in an inside thereof and the insertion includes a second flat surface which is matched with the first flat surface.

4. The embroidery machine as claimed in claim 3, wherein a side hole is defined radially in the needle bar and communicates with the bottom hole, a bolt extends through the side hole and contacts the second flat surface of the insertion.

5. The embroidery machine as claimed in claim 1, wherein a notch is defined in the distal end of the needle bar and a positioning piece extends from the needle frame, the positioning piece is engaged with the notch.

6. The embroidery machine as claimed in claim 1, wherein a protection device located beneath the needle plate and has a passage which is located corresponding to the needle holes.

7. The embroidery machine as claimed in claim 6, wherein the protection device has one end fixed to an underside of the needle plate.

8. The embroidery machine as claimed in claim 6, wherein the protection device extends from a board which is fixed to an underside of the base and the protection device extends toward the needle holes of the needle plate.

9. The embroidery machine as claimed in claim 1, wherein a positioning member is fixedly mounted to the needle bar and has a central hole which communicates with the bottom hole of the needle bar, the insertion of the needle frame extends through the central hole and is inserted into the bottom hole.

10. The embroidery machine as claimed in claim 9, wherein the alignment device includes a notch defined in an underside of the positioning member and a positioning piece is axially connected to the needle frame so as to be engaged with the notch.

11. The embroidery machine as claimed in claim 9, wherein the alignment device includes a notch defined in a top of the needle frame and a positioning piece is axially connected to an underside of the positioning member so as to be engaged with the notch.

12. The embroidery machine as claimed in claim 9, wherein the alignment device includes at least one notch defined in an underside of the positioning member and at least one positioning piece extends radially from the insertion of the needle frame so as to be engaged with the at least one notch.

13. The embroidery machine as claimed in claim 9, wherein the alignment device includes a positioning piece extends radialy through the positioning member and the insertion of the needle frame has a groove defined in a top thereof, the positioning piece is engaged with the groove.

14. An embroidery machine comprising:

a base having an upright column and an arm having an end connected to the upright column, a needle bar movably connected to the arm, a needle plate connected to a top of the base, the needle plate having needle holes defined therethrough, a needle unit connected to a distal end of the needle bar, the needle plate located beneath the needle unit which removably extend through the holes in the needle plate, and a protection device located beneath the needle plate and including a tubular member with a longitudinal passage and the tubular member is located corresponding to the needle holes, the protection device including a board and the tubular member extends from the board, the board is fixed to the base, a collection drawer removably connected to the base and having an open top which faces the needle holes of the needle plate.

15. An embroidery machine comprising:

a base having an upright column and an arm having an end connected to the upright column, a needle bar movably connected to the arm, a needle plate connected to a top of the base, the needle plate having needle holes defined therethrough, a needle unit connected to a distal end of the needle bar, the needle plate located beneath the needle unit which removably extend through the holes in the needle plate, and a protection device located beneath the needle plate and including a tubular member with a longitudinal passage and the tubular member is located corresponding to the needle holes, the tubular member extending from a board which is fixed to an underside of the base and the tubular member extending toward the needle holes of the needle plate, a collection drawer removably connected to the base and having an open top which faces the needle holes of the needle plate.

16. An embroidery machine comprising:

a base having an upright column and an arm having an end connected to the upright column, a needle bar movably connected to the arm, a needle plate connected to a top of the base, the needle plate having needle holes defined therethrough, a needle unit connected to a distal end of the needle bar, the needle plate located beneath the needle unit which removably extend through the holes in the needle plate, and a protection device located beneath the needle plate and including a tubular member with a longitudinal passage and the tubular member is located corresponding to the needle holes, the protection device being a board fixed to a distal end of the base and has a top flange overlaps on the top surface of the base, a collection drawer removably connected to the base and having an open top which faces the needle holes of the needle plate.

17. An embroidery machine comprising:

a base having an upright column and an arm having an end connected to the upright column, a needle bar movably connected to the arm, a needle plate connected to a top of the base, the needle plate having needle holes defined therethrough;

a needle frame having a top thereof connected to a distal end of the needle bar and a needle unit connected to an underside of the needle frame, the needle plate located beneath the needle unit which removably extend through the holes in the needle plate, and an alignment device connected between the needle bar and the needle frame so that the needle frame is connected to the needle bar by a guidance of the alignment device.

18. The embroidery machine as claimed in claim 17, wherein the needle unit includes a plurality of needles which are inserted into receiving holes defined in the underside of the needle frame and a plurality of contact bolts threadedly extend through radial holes defined in the needle frame and contact the needles.

* * * * *